US007471233B2

(12) United States Patent
Kurihara et al.

(10) Patent No.: US 7,471,233 B2
(45) Date of Patent: Dec. 30, 2008

(54) ELECTROMAGNETIC WAVE ABSORBER

(75) Inventors: Hiroshi Kurihara, Tokyo (JP); Toshifumi Saito, Tokyo (JP)

(73) Assignee: TDK Corporation, Tokyo (JP)

( * ) Notice: Subject to any disclaimer, the term of this patent is extended or adjusted under 35 U.S.C. 154(b) by 120 days.

(21) Appl. No.: 11/128,338

(22) Filed: May 13, 2005

(65) Prior Publication Data

US 2006/0066467 A1 Mar. 30, 2006

(30) Foreign Application Priority Data

May 31, 2004 (JP) ..... 2004-161112

(51) Int. Cl.
*H01Q 17/00* (2006.01)

(52) U.S. Cl. ..... 342/4; 342/1

(58) Field of Classification Search ..... 342/1–4; 361/816, 818; 181/295, 284, 286, 294; 250/250
See application file for complete search history.

(56) References Cited

U.S. PATENT DOCUMENTS

| | | | | |
|---|---|---|---|---|
| 2,985,880 | A * | 5/1961 | McMillan | 343/910 |
| 3,348,224 | A * | 10/1967 | McMillan | 342/1 |
| 3,498,405 | A * | 3/1970 | Charpentier | 181/291 |
| 3,526,896 | A * | 9/1970 | Wesch | 342/1 |
| 3,631,492 | A * | 12/1971 | Suetake et al. | 342/4 |
| 4,050,073 | A * | 9/1977 | Wesch | 342/4 |
| 4,118,704 | A * | 10/1978 | Ishino et al. | 342/4 |
| 4,164,718 | A * | 8/1979 | Iwasaki | 333/81 R |
| 4,297,708 | A * | 10/1981 | Vidal | 343/754 |
| 5,081,455 | A * | 1/1992 | Inui et al. | 342/1 |
| 5,208,599 | A * | 5/1993 | Rudduck et al. | 342/4 |
| 5,331,567 | A * | 7/1994 | Gibbons et al. | 703/1 |
| 5,373,296 | A * | 12/1994 | Ishino et al. | 342/4 |
| 5,492,749 | A * | 2/1996 | Solves et al. | 428/172 |
| 5,537,116 | A * | 7/1996 | Ishino et al. | 342/1 |
| 5,844,518 | A * | 12/1998 | Berg et al. | 342/2 |
| 5,892,188 | A * | 4/1999 | Hayashi et al. | 181/295 |
| 6,043,769 | A * | 3/2000 | Rowe et al. | 342/4 |
| 6,217,978 | B1 * | 4/2001 | Murase et al. | 428/116 |
| 6,259,394 | B1 * | 7/2001 | Murase et al. | 342/1 |
| 6,359,581 | B2 * | 3/2002 | Kurihara et al. | 342/4 |
| 6,373,425 | B1 | 4/2002 | Inoue et al. | |

(Continued)

FOREIGN PATENT DOCUMENTS

| | | |
|---|---|---|
| EP | 0 485 635 | 5/1992 |

(Continued)

OTHER PUBLICATIONS

Holloway et al. "Effective Electromagnetic Material Properties for Alternating Wedges and Hollow Pyramidal Absorbers". Antennas and Propagation Society International Symposium. Jul. 13-18, 1997. vol. 4. pp. 2292-2295.*

*Primary Examiner*—Thomas H Tarcza
*Assistant Examiner*—Matthew M Barker
(74) *Attorney, Agent, or Firm*—Leydig, Voit & Mayer, Ltd.

(57) ABSTRACT

An electromagnetic wave absorber includes a first electromagnetic wave absorbent member containing a magnetic loss material, and a second electromagnetic wave absorbent member containing a conducting material arranged in front of the first electromagnetic wave absorbent member. The second electromagnetic wave absorbent member has a shape including an aperture at a tip of a hollow cone.

15 Claims, 9 Drawing Sheets

U.S. PATENT DOCUMENTS

| | | | | |
|---|---|---|---|---|
| 6,407,693 | B1 * | 6/2002 | Murase et al. | 342/4 |
| 6,419,772 | B1 * | 7/2002 | Takamatsu et al. | 156/71 |
| 6,738,008 | B1 | 5/2004 | Liu et al. | |
| 6,771,204 | B2 * | 8/2004 | Hayashi et al. | 342/1 |
| 6,784,419 | B1 * | 8/2004 | Hayashi et al. | 250/250 |
| 2001/0024121 | A1 * | 9/2001 | Kurihara et al. | 324/312 |
| 2003/0108744 | A1 * | 6/2003 | Kuchler et al. | 428/403 |
| 2003/0146866 | A1 * | 8/2003 | Hayashi et al. | 342/1 |
| 2005/0103568 | A1 * | 5/2005 | Sapoval et al. | 181/293 |

FOREIGN PATENT DOCUMENTS

| | | | |
|---|---|---|---|
| JP | 62-45100 | | 2/1987 |
| JP | 62-134297 | U | 8/1987 |
| JP | 2-161799 | A | 6/1990 |
| JP | 3-204999 | | 9/1991 |
| JP | 6-132691 | | 5/1994 |
| JP | 6-275981 | | 9/1994 |
| JP | 7-193388 | | 7/1995 |
| JP | 8-67544 | A | 3/1996 |
| JP | 10-217217 | | 8/1998 |
| JP | 10-224078 | A | 8/1998 |
| JP | 10-275996 | | 10/1998 |
| JP | 2000-77883 | | 3/2000 |
| JP | 2000-82893 | | 3/2000 |
| JP | 2000-277972 | | 10/2000 |
| JP | 2001-244686 | | 9/2001 |
| JP | 2002-9482 | | 1/2002 |

* cited by examiner tip width = 0 tip width = 100mm tip width = 200mm tip width = 300mm tip width = 400mm tip width = 500mm tip width = 600mm Changes of characteristics in low-frequency (30-100MHz) depending on changes of tip width

ELECTROMAGNETIC WAVE ABSORBER

BACKGROUND OF THE INVENTION

1. Field of the Invention

The present invention relates to an electromagnetic wave absorber of a broadband characteristic used for an electromagnetic wave anechoic room or the like.

2. Description of the Prior Art

An electromagnetic wave anechoic room is put to practical use widely as an examination room to measure an electromagnetic wave noise radiated by various electronic machines and to evaluate a tolerance of an electronic device interfered by an outside electromagnetic wave noise. And recently, there is a movement that the electromagnetic wave anechoic room is used for a place (CALTS=Calibration Test Site) to proofread an antenna for a radiation noise measurement.

Electromagnetic wave absorbers are installed in a ceiling and walls of these electromagnetic wave anechoic rooms for EMC (Electromagnetic Compatibility), therefore, a space is realized where electromagnetic wave reflections from the one except for a floor side (metal side) are very small.

A performance of an electromagnetic wave anechoic room for EMC is evaluated by measuring site attenuation. The site attenuation is an electromagnetic wave attenuation characteristic between transmission and reception antennas where it is measured in an established method in a predetermined measurement place. The site attenuation is measured in a frequency range of 30 MHz-1 GHz (or 18 GHz). Comparing ideal site attenuation (theoretical value) with a measured value of the site attenuation in an electromagnetic wave anechoic room, the electromagnetic wave anechoic room is high-performance as much as the difference is small between the theoretical value and the measured value. Usually, it is suitable as a measurement place of the radiation noise if the difference from the theoretical value is within the range of ±4 dB, but recently, there are many cases that ±3 dB is required, more case, high-performance of ±1 dB-±2 dB is required. It is because a radiation noise measurement of higher precision is provided as much as the difference from the theoretical value is small. If measurement precision in the electromagnetic wave anechoic room rises, electronic device makers can decrease a margin to a standard value when they measure the radiation noise of the products and confirm that the radiation noise is less than the standard value. As a result, there is an advantage to restrain a noise countermeasure cost.

On the other hand, because high precision is necessary when an electromagnetic wave anechoic room is used as a place to proofread an antenna, it requires high-performance of ±1 dB-±1.5 dB.

It is mostly said that an absorption characteristic of electromagnetic wave absorbers installed in a ceiling and walls of an electromagnetic wave anechoic room for EMC is required more than 20 dB with 30 MHz-18 GHz. The required characteristic depends on not only a performance of the electromagnetic wave anechoic room (difference between the theoretical value and the measured value of the site attenuation), but also a size of the electromagnetic wave anechoic room, a measurement distance and frequency and so on. Especially, a case of an electromagnetic wave anechoic room of 10 m method (the measurement distance is 10 m), the characteristic in low frequency of 30-100 MHz should be better than the characteristic in high frequency beyond 100 MHz. It results in terms of measurement of the site attenuation. In other words, it is because receiving electric field strength in the low frequency of 30-100 MHz is smaller than one in the high frequency beyond 100 MHz in case of a horizontal wave, so the reflected wave from the ceiling and the walls may influence the measured value, and the difference from the theoretical value grows large easily.

As an Electromagnetic wave absorber installed in the ceiling and the walls of the electromagnetic wave anechoic rooms for EMC, a complex type electromagnetic wave absorber is frequently used at present. The complex type electromagnetic wave absorber is, as shown in FIG. 9, a combination of a ferrite sintered compact 1 as an electromagnetic wave absorbent member consisting of magnetic loss material and a dielectric loss material 2 (This is also said an ohm loss factor, too.) as an electromagnetic wave absorbent member containing a conducting material.

The ferrite sintered compact absorbs electromagnetic waves by magnetic loss, and has an excellent characteristic in low frequency of about 30-400 MHz only with a thin thickness of several mm. On the other hand, The dielectric loss member is composed of a base material (low permittivity dielectric) such as foamed polystyrol or foamed polyurethane etc. containing a conducting material such as carbon or graphite or the like. The dielectric loss member absorbs electromagnetic waves by ohm loss, and has a better characteristic as much as frequency is high.

The complex type electromagnetic wave absorber is made to have the broadband characteristic by combining the ferrite sintered compact of excellent in low frequency characteristic and the dielectric loss member of excellent in high frequency characteristic. In comparison with usual wave absorber composed of only the dielectric loss member, the complex type electromagnetic wave absorber has a merit to make a length of the electromagnetic wave absorber less than half.

Usually, said dielectric loss member has a tapered shape such as a pyramid form or a wedge form or the like. The reason to provide the tapered shape is to receive and absorb electromagnetic waves efficiently with restraining reflection by making an impedance change gradually against incident electromagnetic waves from free space.

The dielectric loss member of 0.5-2 m in length is usually used, but there is a case that the member of 3 m and more in length is used according to the required performance of the electromagnetic wave anechoic room, because the dielectric loss member is higher performance as much as long one. So, for cost reduction with lightening and material reduction, shown in Japanese Patent Application Laid-Open No. 4-44300, an electromagnetic wave absorber of a hollow dielectric loss member is put to practical use. As a shape of the hollow dielectric loss member, there is a hollow pyramid structure shown in FIGS. 10A, 10B, and a hollow wedge structure shown in FIGS. 11A, 11B. In the FIGS. 10A, 10B and FIGS. 11A, 11B, numeral 1 is a ferrite sintered compact, 2 is a hollow dielectric loss member arranged to front of the ferrite sintered compact. Moreover, shown in Japanese Patent No. 3036252, and No. 3035110, they describe forms composed of a wedge shape structure by fitting two boards each other.

By the way, the hollow wedge structure and the wedge structure composed of fitting two boards each other have a problem that a difference in the characteristic is caused by a polarization plane of an arrival electromagnetic wave. A case of the wedge structure composed of fitting two boards each other, there is another problem in strength that each board cause sag or the like when a length of the boards is long.

On the other hand, a case of the hollow pyramid structure, there is no difference in the characteristic caused by the polarization plane of the arrival electromagnetic wave, and mechanical strength is strong. But, there is a problem that the absorber must be made long, because the low-frequency characteristic of 30-100 MHz was inferior in comparison with the hollow wedge structure.

SUMMARY OF THE INVENTION

Under such circumstance, a first object of the invention is to provide an electromagnetic wave absorber that can decrease weight and cost.

Another object of the invention is to provide an electromagnetic wave absorber that can obtain prefer absorption characteristic of electromagnetic waves in low-frequency as well as high-frequency with a short length, and cause no difference in the characteristic by a polarization plane of an arrival electromagnetic wave.

The other objects as well as new features of the invention are described in embodiments mentioned below.

To achieve the above-mentioned objects, the invention provides an electromagnetic wave absorber, comprising: a first electromagnetic wave absorbent member containing a magnetic loss material; and a second electromagnetic wave absorbent member containing a conducting material arranged to front of the first electromagnetic wave absorbent member; wherein the second electromagnetic wave absorbent member has a shape that is formed an aperture at a tip of a hollow cone.

The invention further provides an electromagnetic wave absorber wherein the second electromagnetic wave absorbent member containing the conducting material has a shape that is formed an aperture at a tip of a hollow quadrangular pyramid, and a ratio of a tip width to a bottom end width of the quadrangular pyramid is 0.25-0.75.

The invention further provides an electromagnetic wave absorber wherein the second electromagnetic wave absorbent member containing the conducting material has a jagged shape at an edge of the tip.

The invention further provides an electromagnetic wave absorber wherein the second electromagnetic wave absorbent member containing the conducting material is composed of a plurality of boards.

The invention further provides an electromagnetic wave absorber wherein the second electromagnetic wave absorbent member containing the conducting material is composed of a plurality of division bodies of the second electromagnetic wave absorbent member connected in a longitudinal direction.

The invention further provides an electromagnetic wave absorber wherein the second electromagnetic wave absorbent member containing the conducting material has a composition including the conducting material inside.

The invention further provides an electromagnetic wave absorber wherein the second electromagnetic wave absorbent member containing the conducting material has a conducting layer containing the conducting material in a surface.

The invention further provides an electromagnetic wave absorber wherein a bottom absorbent member is arranged between the first electromagnetic wave absorbent member and the second electromagnetic wave absorbent member.

The invention further provides an electromagnetic wave absorber wherein the bottom absorbent member contains a conducting material.

The invention further provides an electromagnetic wave absorber wherein the bottom absorbent member has a tapered shape part, which is located in the hollow part of the second electromagnetic wave absorbent member.

The invention further provides an electromagnetic wave absorber wherein the bottom absorbent member has a shape part that supports the second electromagnetic wave absorbent member containing the conducting material.

The invention further provides an electromagnetic wave absorber wherein the magnetic loss material is a ferrite sintered compact.

DETAILED DESCRIPTION OF THE PREFERRED ENBODIMENTS

Embodiments of the invention as to an electromagnetic wave absorber will be described below with reference to the drawings.

Figure 1A:
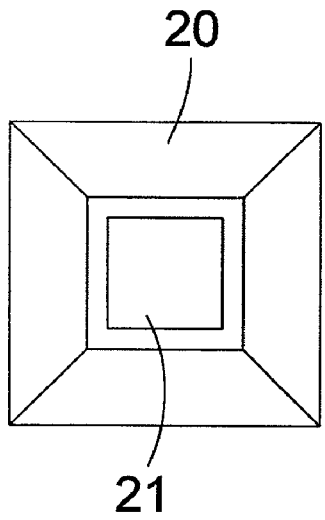
FIG. 1A is a front view showing a first embodiment of an electromagnetic wave absorber according to the invention.
Figure 1B:
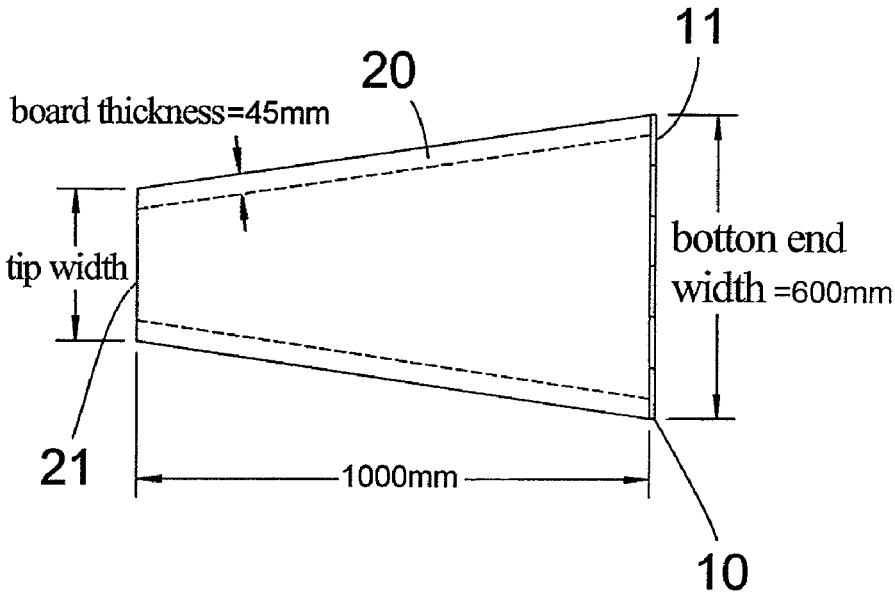
FIG. 1B is a side view of the same.
Figure 2A:
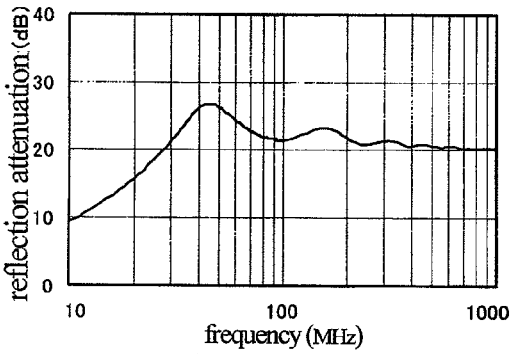
FIG. 2A is a graph of reflection attenuation versus frequency characteristic in the first embodiment in case of tip width=0 of an electromagnetic wave absorbent member containing a conducting material.
Figure 2B:
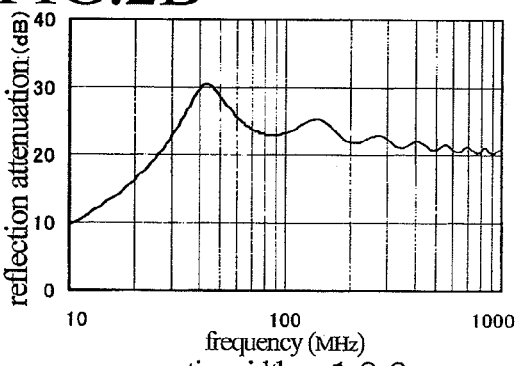
FIG. 2B is a graph in case of tip width=100 mm.
Figure 2C:
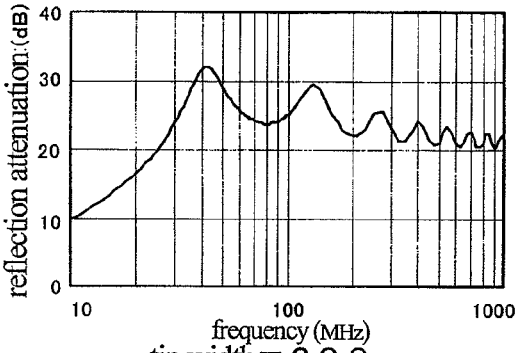
FIG. 2C is a graph in case of tip width=200 mm.
Figure 2D:
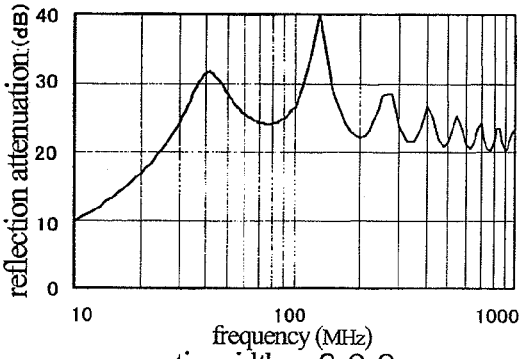
FIG. 2D is a graph in case of tip width=300 mm.
Figure 2E:
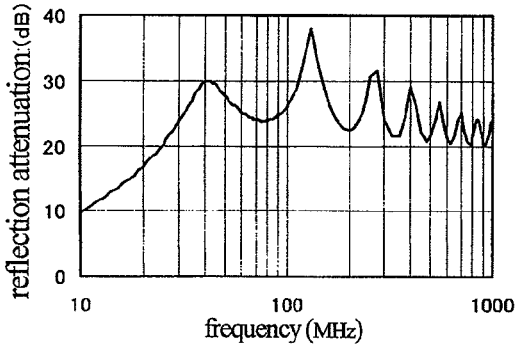
FIG. 2E is a graph in case of tip width=400 mm.
Figure 2F:
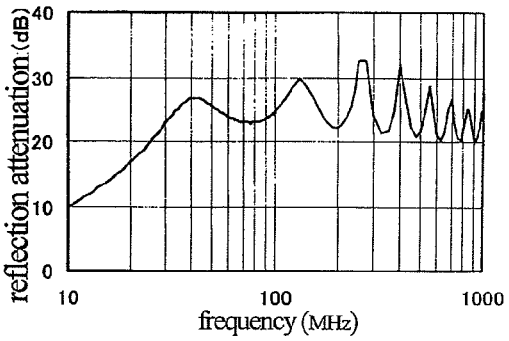
FIG. 2F is a graph in case of tip width=500 mm.
Figure 2G:
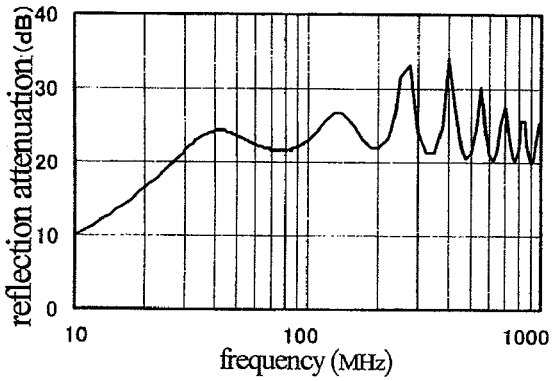
FIG. 2G is a graph in case of tip width=600 mm.

A first embodiment of an electromagnetic wave absorber of the invention is explained according to FIGS. 1A, 1B-FIG. 3. As shown in FIGS. 1A, 1B, the electromagnetic wave absorber comprises a flat plate-shaped electromagnetic wave absorbent member 10 (a first electromagnetic wave absorbent member) which is made by spreading plate-shaped ferrite sintered compacts 11 as a magnetic loss material without gap so as to compose a flat plate-shaped wall body, and an electromagnetic wave absorbent member 20 (a second electromagnetic wave absorbent member) containing a conducting material which is arranged to front of the flat plate-shaped electromagnetic wave absorbent member 10. The electromagnetic wave absorbent member 20 has a shape that is formed an aperture 21 at the tip of a hollow cone. The electromagnetic wave absorbent member 20 is glued in front of the flat plate-shaped electromagnetic wave absorbent member 10 with, for example, adhesive or the like. In case of the drawings, the electromagnetic wave absorbent member 20 has the shape that an aperture 21 is formed by cutting out the tip of the hollow square pyramid, and consists of a dielectric loss member which is composed of a base material such as foamed polystyrol or foamed polyurethane etc. containing a conducting material such as carbon or graphite or the like.

In this case, the electromagnetic wave absorbent member 20 which is the shape the aperture 21 is formed at the tip of the hollow cone can be composed of combining boards of the dielectric loss material and unifying the boards with adhesive or the like, too.

Moreover, a surface member which is transparent as for electromagnetic waves can be fitted on the tip of the cone, so that the inside of a electromagnetic wave anechoic room can be lightened more by making the surface member light color such as white or the like.

Here, changes of characteristics are investigated about the electromagnetic wave absorber described FIG. 1A, 1B, in the case a the bottom end width of the electromagnetic wave absorbent member 20 is fixed on 600 mm and the tip width is made to change with 0, 100, 200, 300, 400, 500 and 600 mm. More, a length of the dielectric loss member composing the electromagnetic wave absorbent member 20 is set at 1 m, and the board thickness of the member 20 is 45 mm. The case of the tip width=0 is equivalent to the usual hollow pyramid shape.

A characteristic of the electromagnetic wave absorber depends on the length and shape of the electromagnetic wave absorbent member 20 containing the conducting material, and also depends on the base material of a dielectric loss material included in the member 20, a kind and a content of the conducting material, and a quality and a thickness of the ferrite sintered compact. As for the investigation example of the changes of characteristics here, the dielectric loss material is composed of foamed polystyrol containing graphite, and the quality of the ferrite sintered compact 11 is a ferrite of Ni—Cu—Zn family of excellent in low frequency characteristic. And, the graphite content and the thickness of the ferrite sintered compact are optimized to satisfy the following characteristic condition.

As mentioned in the above, a case of the electromagnetic wave anechoic room of 10 m method, the characteristic in low frequency of 30-100 MHz should be better than the characteristic in high frequency beyond 100 MHz. So, the characteristic condition of the electromagnetic wave absorber in this investigation is made to satisfy more than 20 dB in beyond 100 MHz and to enlarge characteristic value at lower limit in 30-100 MHz as large as possible.

About each case of the tip width=0, 100, 200, 300, 400, 500 and 600 mm of the dielectric loss material, the characteristics of the electromagnetic wave absorption obtained as result of optimizing by making the graphite content and the thickness of the ferrite sintered compact satisfy said characteristic condition are shown in FIGS. 2A, 2B, 2C, 2D, 2E, 2F and 2G (On condition that the rear face of the ferrite sintered compact is backed with a conductor plate of the electromagnetic wave anechoic room.). FIGS. 2A, 2B, 2C, 2D, 2E, 2F and 2G show reflection attenuation versus frequency characteristics in case of the ratio of the tip width to the bottom end width of the electromagnetic wave absorbent member 20 is made to change. As shown in these figures, 20 dB in beyond 100 MHz is satisfied in all, but it is understood that the difference in the characteristic is caused in the low frequency of 30-100 MHz.

Figure 3:
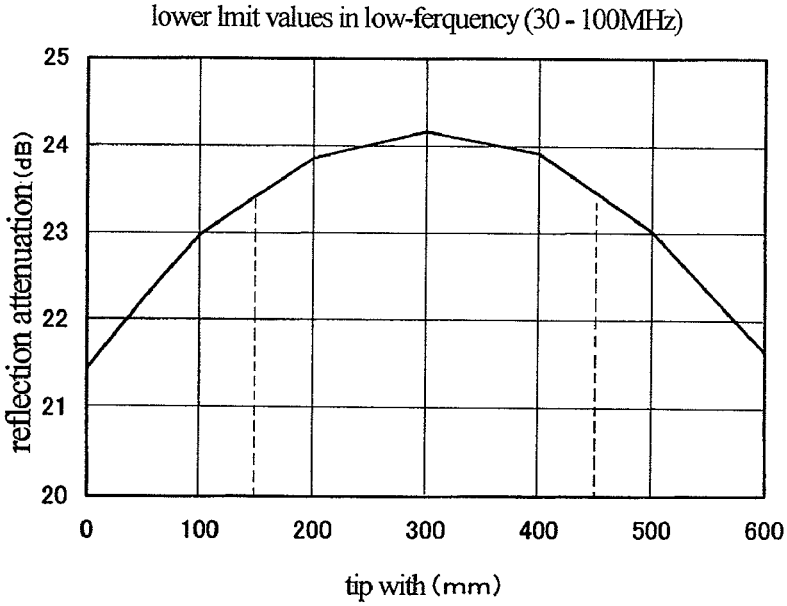
FIG. 3 is a graph of reflection attenuation versus tip width in the first embodiment.

The changes of characteristics in low frequency depending on changes of the tip width are shown in FIG. 3. The characteristic of long tip width is better than that of tip width=0 (ordinary hollow pyramid) in low frequency of 30-100 MHz, especially, it is understood that the lower limit values are improved more than 2 dB in case of tip width=150-450 mm (tip width/bottom end width=0.25-0.75) and these case are favorable.

According to the first embodiment following effects are obtained.

(1) The electromagnetic wave absorber provides the flat plate-shaped electromagnetic wave absorbent member 10 consisting of the ferrite sintered compact 11 as the magnetic loss material, and the electromagnetic wave absorbent member 20 arranged to front of the flat plate-shaped electromagnetic wave absorbent member 10, and the electromagnetic wave absorbent member 20 is the shape that the aperture 21 is formed at the tip of the hollow square pyramid, therefore the characteristic of electromagnetic wave absorption in low frequency is improved with a short length of the member 20.

(2) The electromagnetic wave absorbent member 20 containing conducting material is the hollow structure, lightweight and low-cost can be achieved.

(3) The hollow wedge structure and the wedge structure composed of fitting of two boards each other shown in said Japanese Patent Application Laid-Open No. 4-44300 and Japanese Patent No. 3036252 have a problem that a difference in characteristic is caused by a polarization plane of an arrival electromagnetic wave. But the electromagnetic wave absorbent member 20 in the first embodiment has the outward shape that the tip of the square pyramid is cut out, so it can be realized that the characteristic of electromagnetic wave absorption is caused no difference by the polarization plane of the arrival electromagnetic wave.

(4) The electromagnetic wave absorbent member 20 containing the conducting material is the shape that the aperture 21 is formed at the tip of the hollow square cone and the ratio of the tip width to the bottom end width is set up in 0.25-0.75, so the characteristic of electromagnetic wave absorption in low-frequency, especially 30-100 MHz, is further improved.

(5) The electromagnetic wave absorbent member 20 having the shape that is formed the aperture 21 at the tip of the hollow cone can be composed of combining boards of dielectric loss material and unifying the boards with adhesive or the like. In this case, the member 20 is transported under a condition of the boards, so as to decrease the volume and transport cost.

Figure 4A:
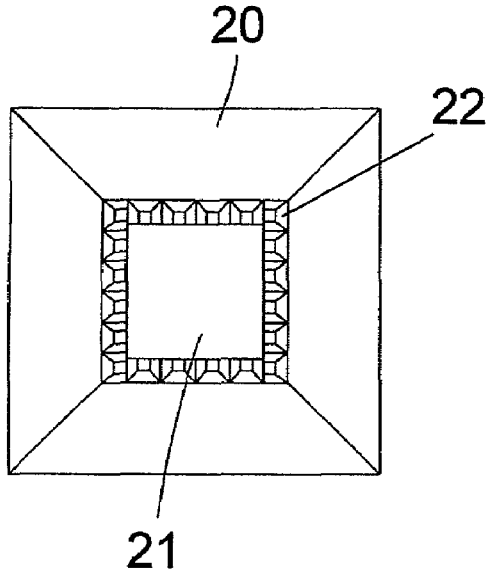
FIG. 4A is a front view showing a second embodiment of an electromagnetic wave absorber according to the invention.
Figure 4B:
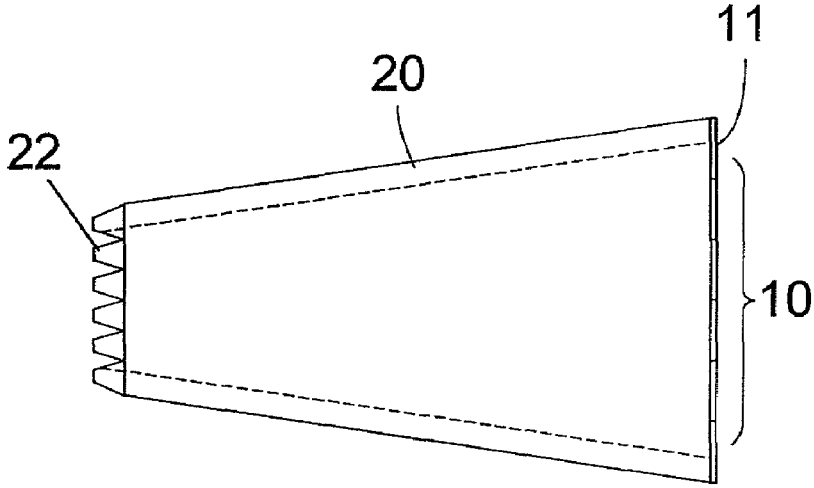
FIG. 4B is a side view of the same.

A second embodiment is explained according to FIGS. 4A, 4B. As shown in the figures, the electromagnetic wave absorbent member 20 containing the conducting material has the shape that the aperture 21 is formed at the tip of the hollow square cone, and more, has a jagged shape 22 at the edge of the surroundings of the aperture 21. The jagged shape 22 is composed of series of little tapered shapes (near cone shape or near mountain shape) or the like.

In this case, the jagged shape 22 formed at the tip of the electromagnetic wave absorbent member 20 has an effect of suppressing reflections in the high frequency of the use frequency range such as an electromagnetic wave anechoic room or the like. Other composition, action and effect are substantially the same as the first embodiment mentioned above, so the explanations are omitted by putting the same signs at the same or common parts.

Figure 5A:
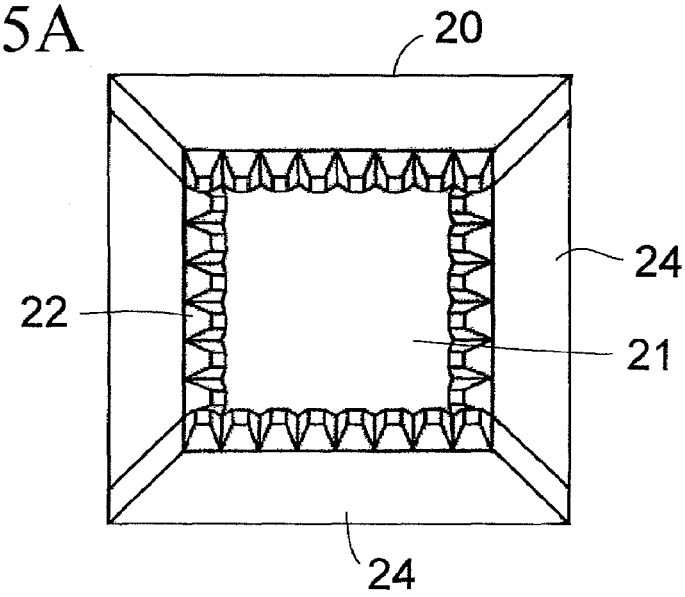
FIG. 5A is a front view showing a third embodiment of an electromagnetic wave absorber according to the invention.
Figure 5B:
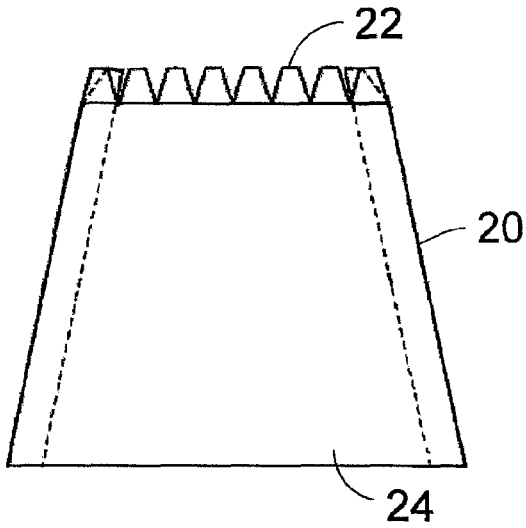
FIG. 5B is a bottom view of the same.
Figure 5C:
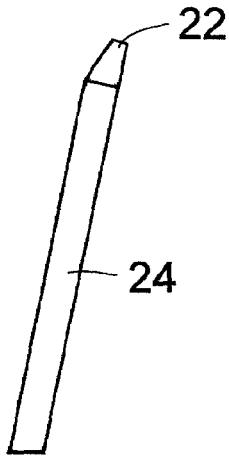
FIG. 5C is a side view of a board composing said electromagnetic wave absorbent member containing the conducting material.

A third embodiment is explained according to FIGS. 5A, 5B. Combining four boards 24 of the dielectric loss material each other as shown in FIG. 5C and unifying the four boards 24 with adhesive or the like, the electromagnetic wave absorbent member 20 containing the conducting material is formed in the shape that the aperture 21 is provided at the tip of the hollow square cone (i.e. hollow square pyramid).

In this case, before assembling, the electromagnetic wave absorbent member 20 can be transported under a condition of the boards 24 so as to decrease the volume and transport cost. More, the jagged shape 22 can be provided at the aperture edge of the electromagnetic wave absorbent member 20, by previously forming the jagged shape 22 at the tip of each board 24. Thus the effect of suppressing reflections is obtained in the high frequency of the use frequency range such as the electromagnetic wave anechoic room or the like. Illustration of the flat plate-shaped electromagnetic wave absorbent member consisting of the ferrite sintered compacts is omitted. Other composition, action and effect are substantially the same as the second embodiment mentioned above, so the explanations are omitted by putting the same signs at the same or common parts.

Figure 6A:
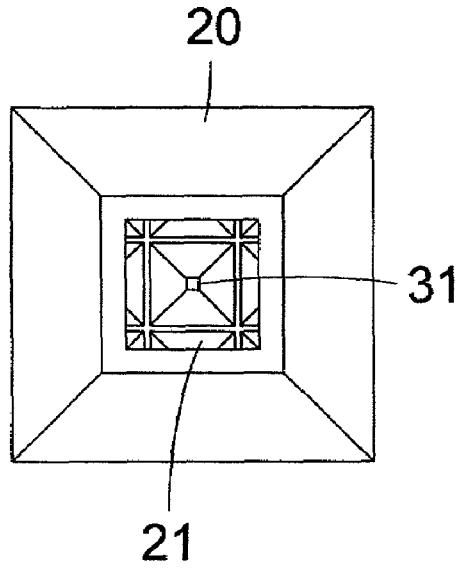
FIG. 6A is a front view showing a forth embodiment of an electromagnetic wave absorber according to the invention.
Figure 6B:
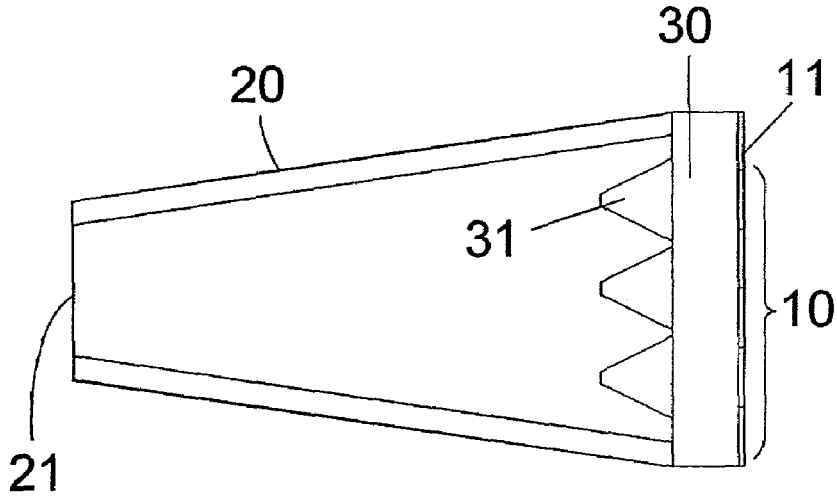
FIG. 6B is a sectional side view of the same.

A fourth embodiment is explained according to FIGS. 6A, 6B. As shown in the figures, a bottom absorbent member 30 is arranged (lied) between the electromagnetic wave absorbent member 10 containing the magnetic loss material and the electromagnetic wave absorbent member 20 containing the conducting material. The bottom absorbent member 30 is a dielectric loss material similar to that of the electromagnetic wave absorbent member 20. Namely the dielectric loss material is composed of a base material such as foamed polystyrol or foamed polyurethane etc. containing a conducting material such as carbon or graphite or the like. And the member 30 has tapered shape parts 31 of which shape made thinner to the tip. The tapered shape parts 31 are made to locate a hollow part of the electromagnetic wave absorbent member 20 containing the conducting material. The parts 31 are, for example, a gathering of a little quadrangular pyramid.

In this case, because the bottom absorbent member 30 covers front of the flat plate-shaped electromagnetic wave absorber 10 consisting of many plate-shaped ferrite sintered compacts 11, reflections from the surface of the ferrite sintered compacts in the high frequency can be suppressed. Further, because the bottom absorbent member 30 provides the tapered shape parts 31, the effect of suppressing the reflections in the high frequency can be enhanced more. Other composition, action and effect are substantially the same as the first embodiment mentioned above, so the explanations are omitted by putting the same signs at the same or common parts.

Figure 7A:
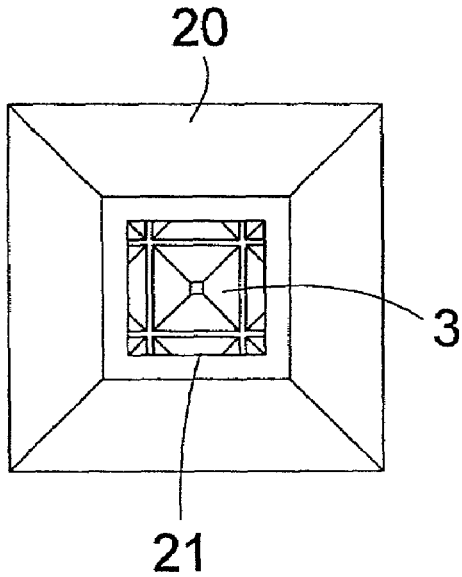
FIG. 7A is a front view showing a fifth embodiment of an electromagnetic wave absorber according to the invention.
Figure 7B:
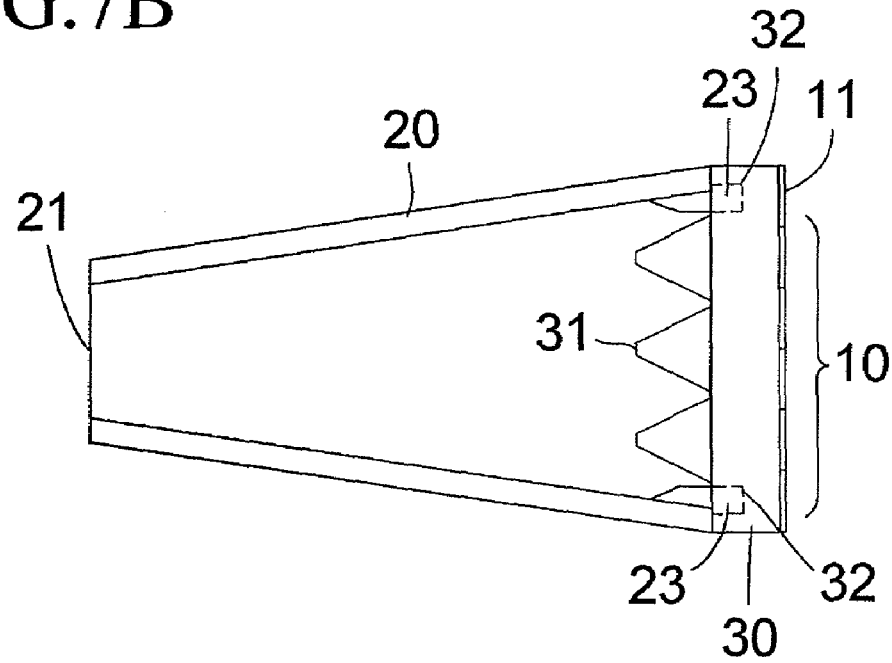
FIG. 7B is a sectional side view of the same.

A fifth embodiment is explained according to FIGS. 7A, 7B. As shown in the figures, in the structure that the bottom absorbent member 30 is arranged (lied) between the electromagnetic wave absorbent members 10 containing the magnetic loss material and the electromagnetic wave absorbent member 20 containing the conducting material, the bottom absorbent member 30 is formed in the shape (for example, engagement structures) of supporting the electromagnetic wave absorbent member 20. Namely, engagement convex parts 23 are formed in the base part of the electromagnetic wave absorbent member 20, and engagement concave parts 32 in which the convex parts 23 are inserted and engaged are formed in the bottom absorbent member 30 as a shape of supporting the electromagnetic wave absorbent member 20.

In this case, the flat plate-shaped electromagnetic wave absorbent member 10 consists of plate-shaped ferrite sintered compacts 11 and the bottom absorbent member 30 which covers the electromagnetic wave absorbent member 10 can be attached at first to the wall of the conductor plate in the electromagnetic wave anechoic room to which electromagnetic wave absorbers should be installed. And then the engagement convex parts 23 of the base part of the electromagnetic wave absorbent member 20 containing the conducting material can be inserted into the engagement concave parts 32 of the bottom absorbent member 30. Therefore there is an advantage that it becomes easy to fit the electromagnetic wave absorbent member 20 to the wall. Other composition, action and effect are substantially the same as the fourth embodiment mentioned above, so the explanations are omitted by putting the same signs at the same or common parts.

A sixth embodiment is explained according to FIGS. 8A, 8B, 8C and 8D. The sixth embodiment is an example in the case that the cone-shaped electromagnetic wave absorbent member 20 containing the conducting material is long. In the example, the electromagnetic wave absorbent member 20 is composed of a plurality of division bodies connected in a longitudinal direction. Namely, the electromagnetic wave absorbent member 20 comprises a first-step (bottom part) division body 40 of the electromagnetic wave absorbent member to be retained on the bottom absorbent member 30, a second-step (the upper part) division body 50 of the electromagnetic wave absorbent member to be connected to the tip of the first-step division body 40, and a frame-shaped middle reinforcement member 60 of a transparent quality as for electromagnetic waves. The member 60 reinforces both connection parts of division bodies 40, 50. The material of transparent quality as for electromagnetic waves is, for example, a low-permittivity dielectric such as foamed polystyrol or the like which does not contain any conducting material.

Two boards 41 of the dielectric loss material having engagement parts 41*a*, 41*b* of concave-convex and two boards 42 of the dielectric loss material having engagement parts 42*a*, 42*b* of concave-convex (Namely, total four boards are used.) are engaged each other, so that the first-step division body 40 of the electromagnetic wave absorbent member is formed in the shape of a tapered square pipe.

In the same way, two boards 51 of the dielectric loss material having engagement parts 51*a*, 51*b* of concave-convex and two boards 52 of the dielectric loss material having engagement parts 52*a*, 52*b* of concave-convex (Namely, total four boards are used.) are engaged each other, so that the second-step division body 50 of the electromagnetic wave absorbent member is formed in the shape of another tapered square pipe.

To the tip side of the first-step division body 40 of the electromagnetic wave absorbent member, the second-step division body 50 of the electromagnetic wave absorbent member is connected by engaging engagement part 41*b*, 42*b*, 51*b*, 52*b* of concave-convex each other. And the frame-shaped middle reinforcement member 60 is attached to make the connection part of the division bodies 40 and 50 surrounded to reinforce the connection part. As a result, the long electromagnetic wave absorbent member 20 containing the conducting material is obtained with the aperture at the tip of the hollow quadrangular pyramid. Occasion of assembling the long electromagnetic wave absorbent member 20, adhesive or the like may be used together.

Figure 8A:
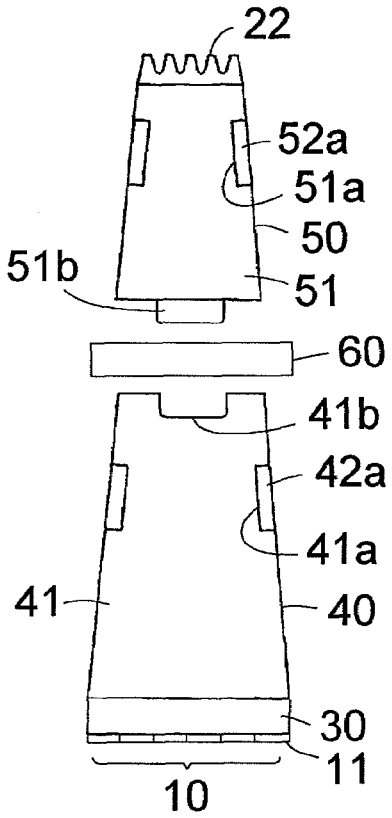
FIG. 8A is a resolution front view showing a sixth embodiment of an electromagnetic wave absorber according to the invention.
Figure 8B:
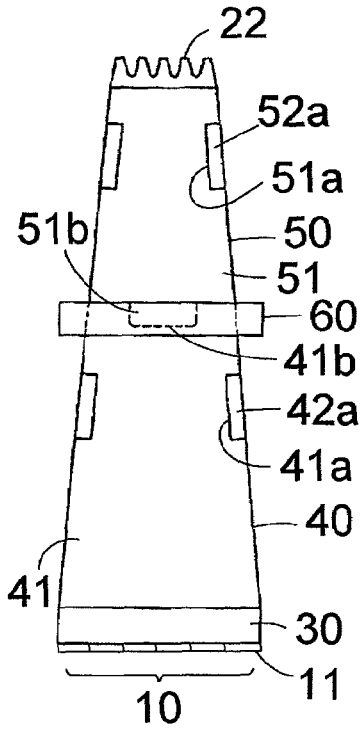
FIG. 8B is a front view of the same.
Figure 8C:
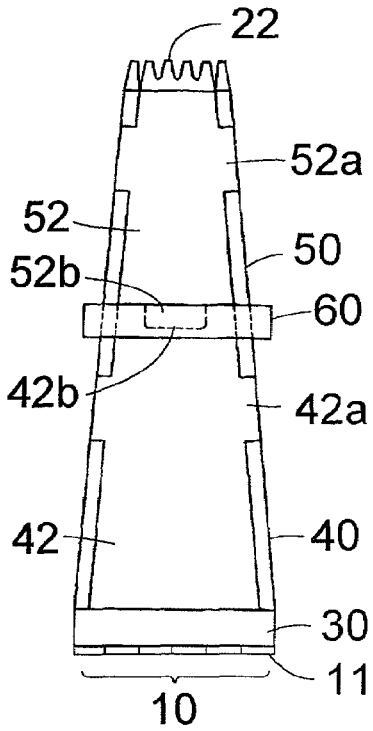
FIG. 8C is a side view of the same.
Figure 8D:
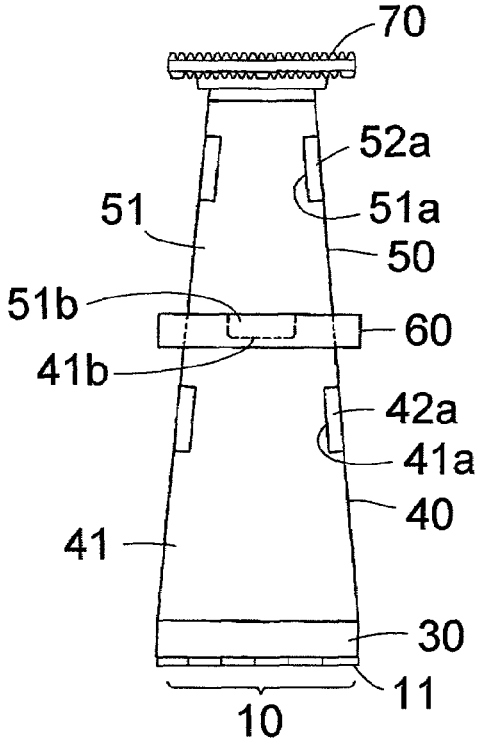
FIG. 8D is a front view after fitting a surface member.
Figure 9:
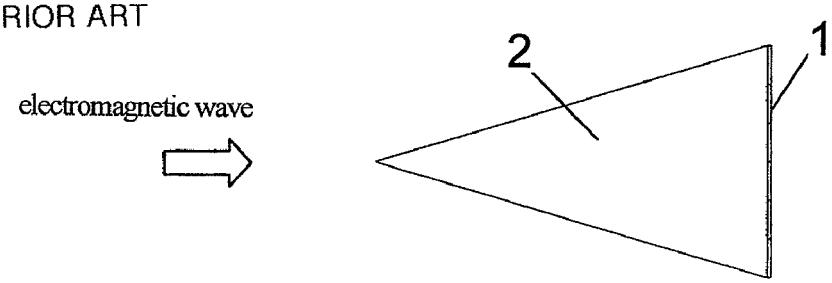
FIG.9 PRIOR ART
FIG. 9 is a side view showing a general composition of a complex type electromagnetic wave absorber.
Figure 10A:
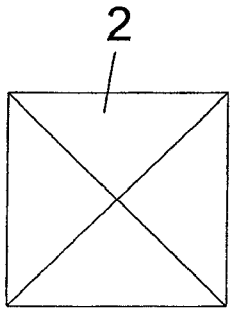
FIG.10A PRIOR ART
FIG. 10A is a front view showing a complex type electromagnetic wave absorber formed in the shape of a hollow pyramid structure.
Figure 10B:
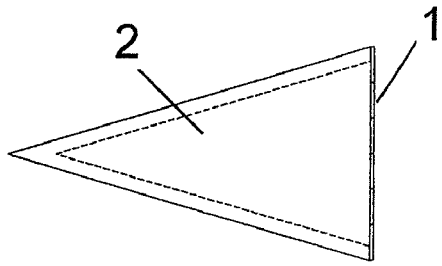
FIG.10B PRIOR ART
FIG. 10B is a side view of the same.
Figure 11A:
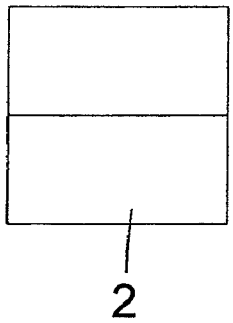
FIG.11A PRIOR ART
FIG. 11A is a front view showing a complex type electromagnetic wave absorber formed in the shape of a hollow wedge structure.
Figure 11B:
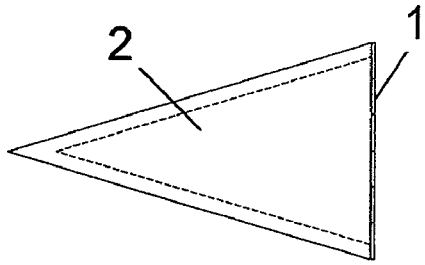
FIG.11B PRIOR ART
FIG. 11B is a side view of the same.

If necessary, as shown in FIG. 8D, a surface member 70 to be transparent as for an electromagnetic wave may be glued with adhesive or the like on the tip aperture of the long electromagnetic wave absorbent member 20 so as to close the aperture.

In the sixth embodiment, if the electromagnetic wave absorbent member 20 is long, it can be transported under the condition of short boards, so that the transport cost can be reduced. The long electromagnetic wave absorbent member 20 is combination of short boards 41, 42, 51, 52, so the assembling work is easy. Moreover, the electromagnetic wave anechoic room provided the surface member 70 that is transparent as for electromagnetic waves can be lightened more by making the surface member 70 a light color such as white. Furthermore, though illustration is omitted, the bottom absorbent member 30 may have the engagement structure or the like as well as the fifth embodiment, so that the first-step division body 40 of the electromagnetic wave absorbent member can be retained by the bottom absorbent member 30.

Other composition, action, and effect are substantially the same as the third embodiment mentioned above, so the explanations are omitted by putting the same signs at the same or common parts.

In each embodiment mentioned above, the electromagnetic wave absorbent member 20 containing the conducting material is not only the composition containing conducting material inside of the base material such as foamed polystyrol or foamed polyurethane etc., but also the member 20 may be the composition having conducting layer containing the conductive material on a surface of the base material.

Although the embodiments of the invention have been described above, the invention is not limited thereto and it will be self-evident to those skilled in the art that various modifications and changes may be made without departing from the scope of claims.

As described above, according to the electromagnetic wave absorber of the invention, the second electromagnetic wave absorbent member containing the conducting material is arranged to front of the first electromagnetic wave absorbent member containing the magnetic loss material, and the second electromagnetic wave absorbent member has a shape that is formed an aperture at a tip of a hollow cone, therefore, electromagnetic wave absorption in low frequency (especially, a range of 30-100 MHz) with short length is improved, so that an electromagnetic wave anechoic room of high-performance is realized. And, the second electromagnetic wave absorbent member containing the conducting material is a hollow structure, so that lightweight and low-cost are realized. Moreover, the second electromagnetic wave absorbent member containing the conducting material has a contour that the tip side of the cone is removed, so it is realized that the electromagnetic wave absorption characteristic is caused no difference by a polarization plane of an arrival electromagnetic wave.

What is claimed is:

1. An electromagnetic wave absorber comprising:

a first electromagnetic wave absorbent member containing a magnetic loss material, the first electromagnetic wave absorbent member being generally planar and having a plurality of base edges with respective base widths; and a second electromagnetic wave absorbent member containing an electrically conducting material, the second electromagnetic wave absorbent member being attached to and located on a first side of the first electromagnetic wave absorbent member, wherein the second electromagnetic wave absorbent member includes a plurality of planar members, each planar member having a bottom end edge, a tip end edge, and side edges extending between the bottom end edges and the tip end edges, the planar members being joined at the bottom end edges to the base edges of first electromagnetic wave absorbent member, each planar member being joined to two other planar members at respective side edges to form a hollow truncated pyramidal shape having an aperture at the tip end edges of the planar members, opposite the first electromagnetic wave absorbent member, the aperture providing access for electromagnetic waves into the hollow truncated pyramidal shape, the tip end edges having respective tip end widths, and ratio of the tip end widths to the base widths is in a range from 0.25 to 0.75 wherein the absorber is configured to absorb electromagnetic waves in a frequency range from 30 MHz to 100 MHz.

2. The electromagnetic wave absorber according to claim 1, wherein the second electromagnetic wave absorbent member containing the electrically conducting material includes, at the tip end edges of the aperture, outwardly extending protrusions having a jagged shape.

3. The electromagnetic wave absorber according to claim 1, wherein each planar member of the second electromagnetic wave absorbent member containing the electrically conducting material includes a plurality of panels serially joined to each other in a longitudinal direction of the hollow truncated pyramidal shape to form the respective planar member.

4. The electromagnetic wave absorber according to claim 1, wherein the second electromagnetic wave absorbent member containing the electrically conducting material has the electrically conducting material inside each of the respective planar members.

5. The electromagnetic wave absorber according to claim 1, wherein the second electromagnetic wave absorbent member containing the electrically conducting material has an electrically conducting layer containing the electrically conducting material at a surface of the respective planar members.

6. The electromagnetic wave absorber according to claim 1, including a bottom absorbent member located on the first electromagnetic wave absorbent member and inside the hollow truncated pyramidal shape of the second electromagnetic wave absorbent member, facing the aperture.

7. The electromagnetic wave absorber according to claim 6, wherein the bottom absorbent member contains an electrically conducting material.

8. The electromagnetic wave absorber according to claim 6, wherein the bottom absorbent member includes at least one projecting pyramidal part facing the aperture.

9. The electromagnetic wave absorber according to claim 6, wherein the bottom absorbent member has a part which supports the second electromagnetic wave absorbent member containing the electrically conducting material.

10. The electromagnetic wave absorber according to claim 1, wherein the magnetic loss material is a sintered ferrite compact.

11. The electromagnetic wave absorber according to claim 1, wherein the hollow truncated pyramidal shape has a length transverse to the first electromagnetic wave absorbent member that is substantially one meter.

12. The electromagnetic wave absorber according to claim 1, wherein the second electromagnetic wave absorbent member includes four of the planar members joined to the first electromagnetic wave absorbent member.

13. The electromagnetic wave absorber according to claim 1, wherein reflection attenuation of the electromagnetic absorber in the frequency range from 30 to 100 MHz is at least 23 dB.

14. The electromagnetic wave absorber according to claim 1, wherein the ratio of the tip end widths to the base widths is in a range from 1/3 to 2/3.

15. The electromagnetic wave absorber according to claim 1, wherein the tip end width is in a range from 100 mm to 500 mm.

* * * * *